US008164524B2

(12) United States Patent
Tang et al.

(10) Patent No.: US 8,164,524 B2
(45) Date of Patent: Apr. 24, 2012

(54) BUILT-IN STRAIGHT MOBILE ANTENNA TYPE DUAL BAND ANTENNA ASSEMBLY WITH IMPROVED HAC PERFORMANCE

(75) Inventors: Chia-Lun Tang, Pa-Te (TW); Yan-Wen Zhao, Chengdu (CN); Jianliang Shen, Chengdu (CN); Danial Chang, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 381 days.

(21) Appl. No.: 12/509,556

(22) Filed: Jul. 27, 2009

(65) Prior Publication Data

US 2011/0018770 A1 Jan. 27, 2011

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,166,694 | A * | 12/2000 | Ying | 343/702 |
| 6,476,769 | B1 * | 11/2002 | Lehtola | 343/702 |
| 7,113,135 | B2 * | 9/2006 | Jo et al. | 343/702 |
| 7,903,039 | B2 * | 3/2011 | Yu | 343/742 |
| 2006/0140428 | A1 | 6/2006 | Qi et al. | |
| 2007/0003088 | A1 | 1/2007 | Lehtola | |

* cited by examiner

*Primary Examiner* — Tan Ho
(74) *Attorney, Agent, or Firm* — Guice Patents PLLC

(57) ABSTRACT

A built-in straight mobile antenna type dual band antenna assembly includes a circuit board, a first radiator transversely arranged on one end of the circuit board and having a first resonance frequency, and a second radiator longitudinally arranged on one lateral side of the circuit board. The first radiator and the second radiator constitute an L-shaped structure for signal input through a feed end, and are connected to a ground plane on the circuit board through a common grounding lug.

8 Claims, 7 Drawing Sheets
(1 of 7 Drawing Sheet(s) Filed in Color)

824MHz HAC performance comparison chart

| Peak E-field in V/m | | | Peak E-field in V/m | | |
|---|---|---|---|---|---|
| ✓ Grid 1 | ✓ Grid 2 | ✓ Grid 3 | ✓ Grid 1 | ✓ Grid 2 | ✓ Grid 3 |
| 239 M3 | 243 M3 | 239 M3 | 228 M3 | 233 M3 | 230 M3 |
| Grid 4 | ✓ Grid 5 | ✓ Grid 6 | ✓ Grid 4 | ✓ Grid 5 | Grid 6 |
| 250 M3 | 254 M3 | 250 M3 | 242 M3 | 247 M3 | 243 M3 |
| Grid 7 | Grid 8 | ✓ Grid 9 | ✓ Grid 7 | Grid 8 | Grid 9 |
| 241 M3 | 246 M3 | 240 M3 | 234 M3 | 239 M3 | 235 M3 |

| Peak H-field in A/m | | | Peak H-field in A/m | | |
|---|---|---|---|---|---|
| Grid 1 | Grid 2 | Grid 3 | Grid 1 | Grid 2 | Grid 3 |
| 0.524 M3 | 0.528 M3 | 0.526 M3 | 0.523 M3 | 0.525 M3 | 0.521 M3 |
| ✓ Grid 4 | ✓ Grid 5 | ✓ Grid 6 | ✓ Grid 4 | ✓ Grid 5 | ✓ Grid 6 |
| 0.374 M4 | 0.375 M4 | 0.375 M4 | 0.378 M4 | 0.378 M4 | 0.376 M4 |
| ✓ Grid 7 | ✓ Grid 8 | ✓ Grid 9 | ✓ Grid 7 | ✓ Grid 8 | ✓ Grid 9 |
| 0.215 M4 | 0.21 M4 | 0.218 M4 | 0.223 M4 | 0.217 M4 | 0.219 M4 |

(Invention antenna) (Reference PIFA antenna)

FIG. 7

1980MHz HAC performance comparison chart

| Peak E-field in V/m | | | Peak E-field in V/m | | |
|---|---|---|---|---|---|
| ✓ Grid 1 | ✓ Grid 2 | ✓ Grid 3 | ✓ Grid 1 | ✓ Grid 2 | ✓ Grid 3 |
| 60.6 M3 | 60.5 M3 | 68.4 M3 | 75.8 M3 | 76.2 M3 | 75 M3 |
| Grid 4 | ✓ Grid 5 | ✓ Grid 6 | Grid 4 | ✓ Grid 5 | ✓ Grid 6 |
| 68.6 M3 | 68.6 M3 | 63.7 M3 | 101 M2 | 103 M2 | 101 M2 |
| Grid 7 | Grid 8 | ✓ Grid 9 | Grid 7 | Grid 8 | ✓ Grid 9 |
| 67 M3 | 67 M3 | 62.5 M3 | 101 M2 | 103 M2 | 101 M2 |

| Peak H-field in A/m | | | Peak H-field in A/m | | |
|---|---|---|---|---|---|
| Grid 1 | Grid 2 | Grid 3 | Grid 1 | Grid 2 | Grid 3 |
| 0.221 M3 | 0.231 M3 | 0.233 M3 | 0.352 M2 | 0.353 M2 | 0.345 M2 |
| ✓ Grid 4 | ✓ Grid 5 | ✓ Grid 6 | ✓ Grid 4 | ✓ Grid 5 | ✓ Grid 6 |
| 0.174 M3 | 0.198 M3 | 0.206 M3 | 0.326 M2 | 0.326 M2 | 0.321 M2 |
| ✓ Grid 7 | ✓ Grid 8 | ✓ Grid 9 | ✓ Grid 7 | ✓ Grid 8 | ✓ Grid 9 |
| 0.104 M4 | 0.142 M3 | 0.162 M3 | 0.224 M3 | 0.219 M3 | 0.216 M3 |

(Invention antenna) (Reference PIFA antenna)

FIG. 8

1980MHzHAC Electric field distribution comparison (Invention antenna)

(Reference PIFA antenna)

1980MHzHAC magnetic field distribution comparison (Invention antenna)

(Reference PIFA antenna)

BUILT-IN STRAIGHT MOBILE ANTENNA TYPE DUAL BAND ANTENNA ASSEMBLY WITH IMPROVED HAC PERFORMANCE

BACKGROUND OF THE INVENTION

1. Field of the Invention

The present invention relates to a built-in straight mobile antenna and more particularly, to a built-in straight mobile antenna type dual band antenna, which improves hearing aid compatibility performance.

2. Description of the Related Art

Following popularity of the work mode of personal digital cellular system, the interference problem of the magnetic field of the radiation of cellular phones with the performance of hearing aids has become more and more serious. Many hearing aid users complain the interference of their cellular telephones with their hearing aids. This problem has seized the attention of cellular telephone manufacturers, network service providers, hearing aid manufacturers and some other organizations.

Federal Communications Commission (FCC) has passed a set of hearing aid compatibility rules designed to make mobile phones more accessible to persons with disabilities. The FCC created a rating system to help consumers with hearing disabilities find a phone that will work with their hearing aids. In order not to interfere with the use of a hearing aid, FCC requires cellular telephone manufacturers to control magnetic interference below a certain level. FCC also requires cellular telephone manufacturers to provide certain models that provide a telecoil coupling function to transmit audio frequency to the hearing aid.

FCC raised the aforesaid request just because cellular telephones are going to disappear from the market. FCC indicated that analog cellular telephones are fully compatible to hearing aids, and requested that every cellular telephone manufacturer must prepare at least two models for each system that satisfy hearing aid compatibility standards (for example, a GSM and CDMA cellular telephone manufacturer must prepare at least 4 models of cellular telephones with telecoil coupling function that satisfy hearing aid compatibility standards). Cell phone manufacturers and cell phone service providers were requested to have at least one half of the available models satisfy hearing air compatibility before Feb. 18, 2008—the day that the analog cellular network was turned off in the U.S.A. completing the switch to digital networks such as GSM. In consequence, ANSI (American National Standards Institute) established "ANSI C63.19" standards.

A regular mobile antenna does not satisfy HAC standards. Many HAC (Hearing Aid Compatibility) related designs have been created. Some HAC related cell phone structure, casing and metal layout patents are known for cell phone applications.

US20060140428 discloses a mobile wireless communications device for a user wearing an electronic hearing aid adjacent an ear of the user, which includes an upper housing and a lower housing being slidably connected together for sliding between a retracted position and an extended use position, and an antenna carried by the lower housing adjacent the bottom end thereof so that the hearing aid is further separated from the antenna when the upper and lower housings are in the extended use position to reduce undesired coupling from the antenna to the hearing aid.

US20070003088 discloses an electronic device, which comprises a ground plane with two opposed edges, an electrical component (second ground plane, a speaker or a telecoil) spaced from the ground plane and disposed so as to not overlie the point with respect to a major surface of the ground plane, and an antenna resonantly coupled to the ground plane, but not resonant with the second ground plane if present. Preferably, the conductor is RF shielded.

However, conventional built-in straight mobile antennas are still not perfect in HAC performance.

SUMMARY OF THE INVENTION

The present invention has been accomplished under the circumstances in view. It is therefore the main object of the present invention to provide a built-in straight mobile antenna type dual band antenna assembly, which has a compact size and greatly improves hearing aid compatibility performance.

To achieve this and other objects of the present invention, the built-in straight mobile antenna type dual band antenna assembly comprises a circuit board and an antenna. The antenna comprises a first radiator transversely arranged on one end of the circuit board and having a first resonance frequency, and a second radiator longitudinally arranged on one lateral side of the circuit board. The first radiator and the second radiator constitute an L-shaped structure for signal input through a feed end, and are connected to a ground plane on the circuit board through a common grounding lug.

When the antenna is disposed under the circuit board and work under 1980 MHz and both the antenna of the present invention and the reference PIFA antenna show an efficiency below 78%; the peak electric field and peak magnetic field of HAC of the antenna assembly of the present invention are 68.6 V/m and 0.198 A/m respectively; the peak electric field and peak magnetic field of HAC of the reference PIFA antenna assembly are 103 V/m and 0.326 A/m respectively. Subject to the aforesaid simulation result, both antennas (the invention antenna and the reference antenna) have a similar HAC characteristic at GSM850 (824 NHz~896 MHz) and satisfy M3 specification of "ANSI C63,19". When at the frequency band of PCS (1850 MHz~1990 MHz) under the same efficiency, the invention shows an improvement above 3.5 dB on electric field and an improvement above 4.3 dB on magnetic field in comparison to the performance of the reference PIFA antenna structure.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

FIG. 7 is a HAC performance comparison chart under a low frequency band (824 MHz) between the dual band antenna assembly of the present invention (left) and the reference PIFA antenna assembly (right).

FIG. 8 is a HAC performance comparison chart under a low frequency band (1980 MHz) between the dual band antenna assembly of the present invention (left) and the reference PIFA antenna assembly (right).

DETAILED DESCRIPTION OF THE PREFERRED EMBODIMENT

Figure 1:
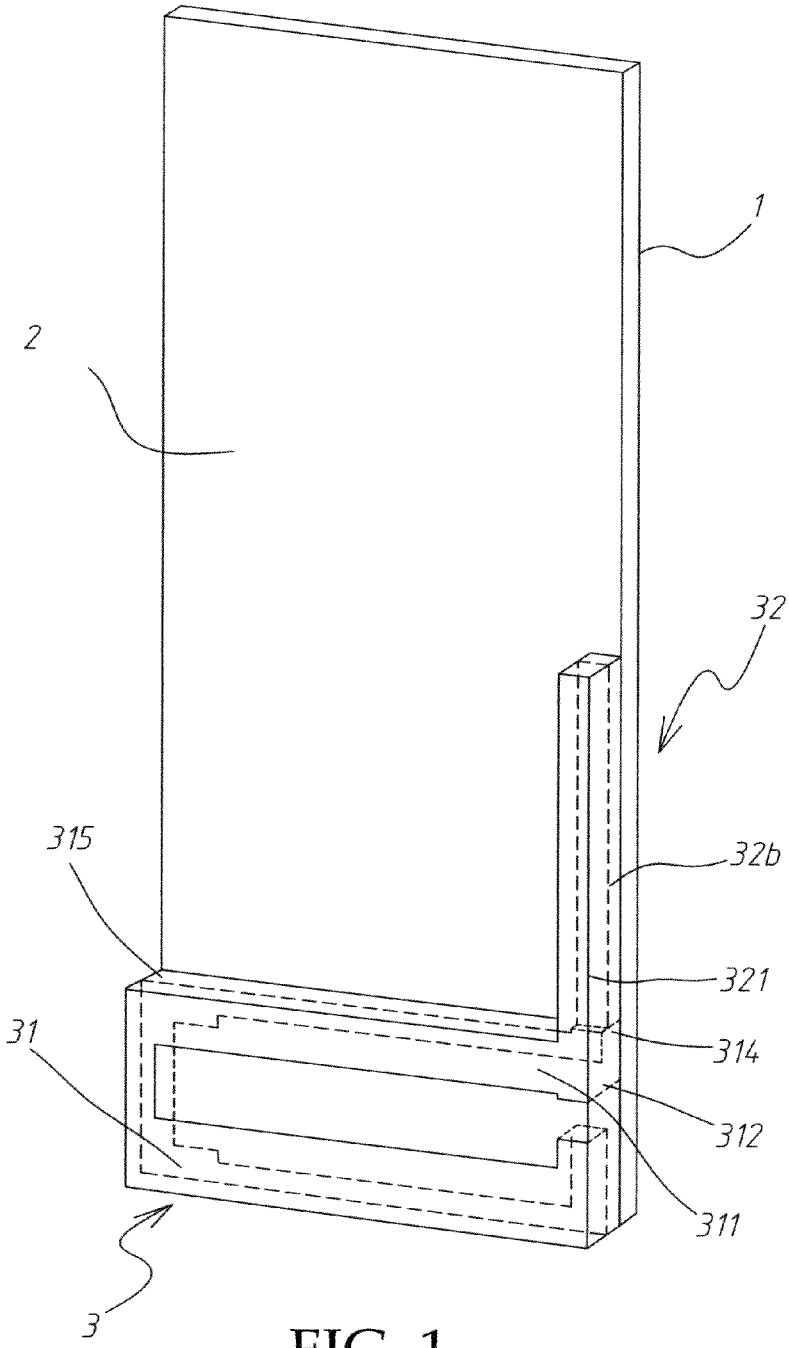
FIG. 1 is a perspective view of a dual band antenna assembly according to the present invention.
Figure 2:
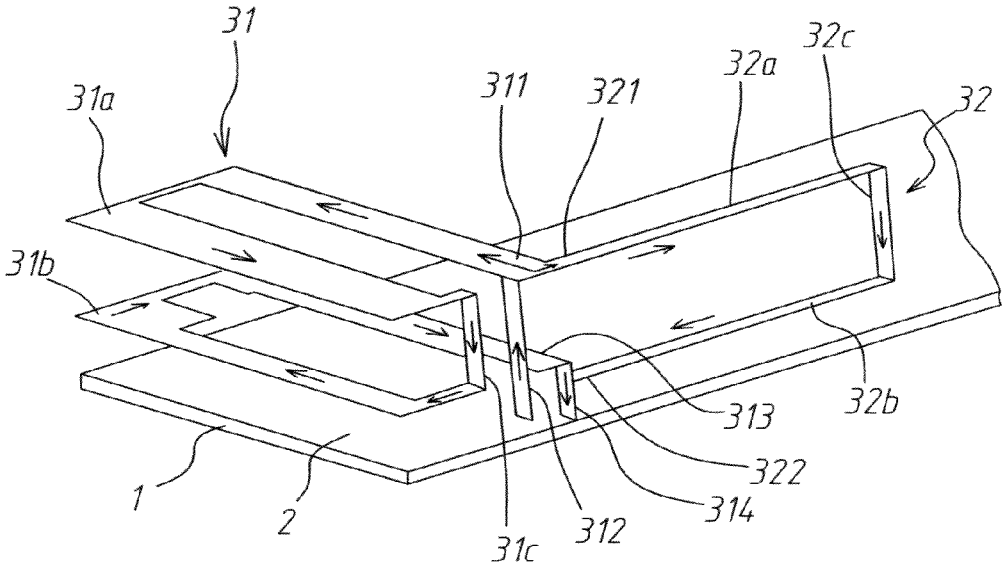
FIG. 2 is an exploded view of a part of the present invention, showing the extending arrangement of the upper pads and bottom pads of the first and second radiators of the antenna after removal of the radiator holder blocks.

Referring to FIGS. 1 and 2, a built-in straight mobile antenna type dual band antenna assembly with improved HAC performance in accordance with the present invention is a built-in straight mobile phone antenna comprising a circuit board 1, a ground plane 2, and an antenna 3.

The circuit board 1 can be a RF4 board carrying the ground plane 2. The antenna 3 is mounted on the circuit board 1, having a first radiator 31 and a second radiator 32.

The first metal radiator 31 has a first resonance frequency. The first metal radiator is arranged on one end of the circuit board 1 and extending along the width of the circuit board 1, having a first end 311 that forms a feed end 311 connected to a feed line 312 for signal input, and a second end 313 connected with a grounding lug 314 to the ground plane 2 (see FIG. 2). The second radiator 2 has a second resonance frequency. The second radiator 2 is arranged on the circuit board 1 and extending along the length of the circuit board 1, having a first end 321 extended from the first end 311 of the first radiator 31, and a second end 322 connected to the ground plane 1 through the grounding lug 314. The feed end 11 and the connection end 21 are disposed at the same side.

The antenna 3 constitutes with the first radiator 31 and the second radiator 32 an L-shaped structure.

The resonance frequency of the first radiator 31 is a low-frequency band, for example, GSM850 (824 MHz~896 MHz). The resonance frequency of the second radiator 32 is a high-frequency band, for example, PCS (1850 MHz~1990 MHz).

The first radiator 31 is mounted on a first radiator holder block 315. The second radiator 32 is mounted on a second radiator holder block 323. The first radiator holder block 315 and the second radiator holder block 323 are made of an electrical insulating material.

As shown in FIG. 2, the first radiator 31 is a dual-pad structure, comprising an upper pad 31*a*, a bottom pad 31*b* and a connection metal 31*c* connecting the upper pad 31*a* and the bottom pad 31*b*. Similarly, the second radiator 32 is a dual-pad structure, comprising an upper pad 32*a*, a bottom pad 32*b* and a connection metal 32*c* connecting the upper pad 32*a* and the bottom pad 32*b*. The upper pad 31*a* and bottom pad 31*b* of the first radiator 31 have different shapes.

As shown in FIG. 2, electric current that is fed into the antenna 2 through the feed line 312 goes in two ways into the first radiator 31 and the second radiator 32 to cause radiation. When entered the feed line 312, a part of electric current goes in proper order through the upper pad 31*a*, connection metal 31*c* and bottom pad 31*b* of the first radiator 31 and is then grounded through the grounding lug 314. At the same time, a part of electric current goes in proper order through the upper pad 32*a*, connection metal 32*c* and bottom pad 32*b* of the second radiator 32 and is then grounded through the grounding lug 314.

Figure 3A:
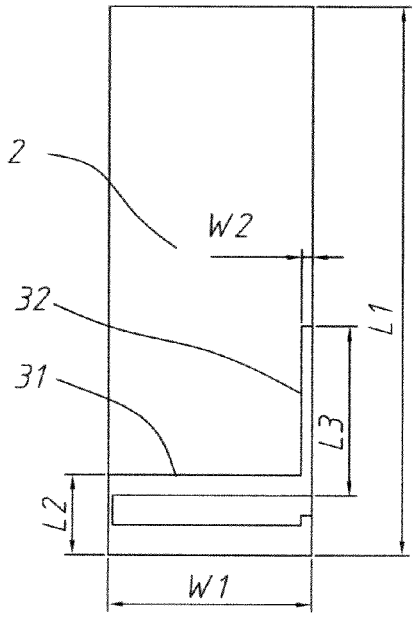
FIG. 3A is a top plain view of a part of the present invention, showing the dimension of the antenna.
Figure 3B:
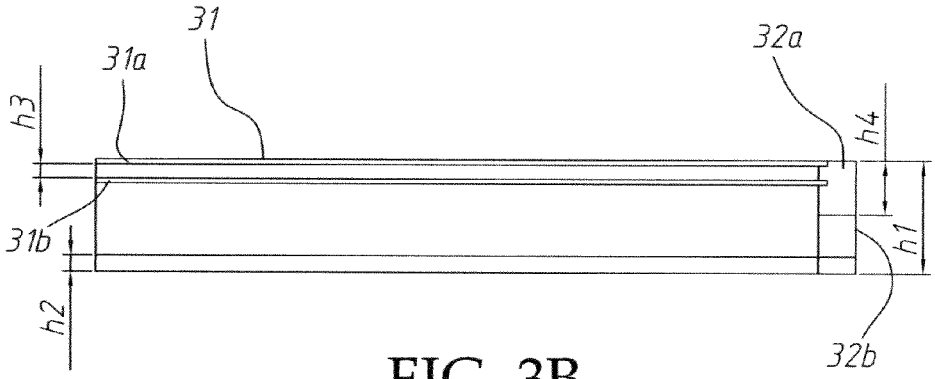
FIG. 3B is a side plain view of a part of the present invention, showing the dimension of the antenna.

FIGS. 3A and 3B show the dimension of the whole antenna structure. As shown in FIG. 3A, the size W1×L1 of the ground plane 12 is 40 mm*110 mm; the size W1×L2 of the first radiator 31 is 40 mm*16 mm; the size L3×W2 of the second radiator 32 is 30 mm*2 mm.

Although the second radiator 32 is mounted on one lateral side of the circuit board 1, the limited width of 2 mm of the second radiator 32 does not interfere with the circuit layout.

As shown in FIG. 3B, the combined height h1 of the first radiator 31 and second radiator 32 of the antenna 3 is smaller than 7 mm; the thickness h2 of the ground plane 2 is 1 mm; the gap h3 between the upper pad 31*a* and bottom pad 31*b* of the first radiator 31 is about 1.5 mm; the gap h4 between the upper pad 32*a* and bottom pad 32*b* of the second radiator 34 is about 3 mm.

Figure 4:
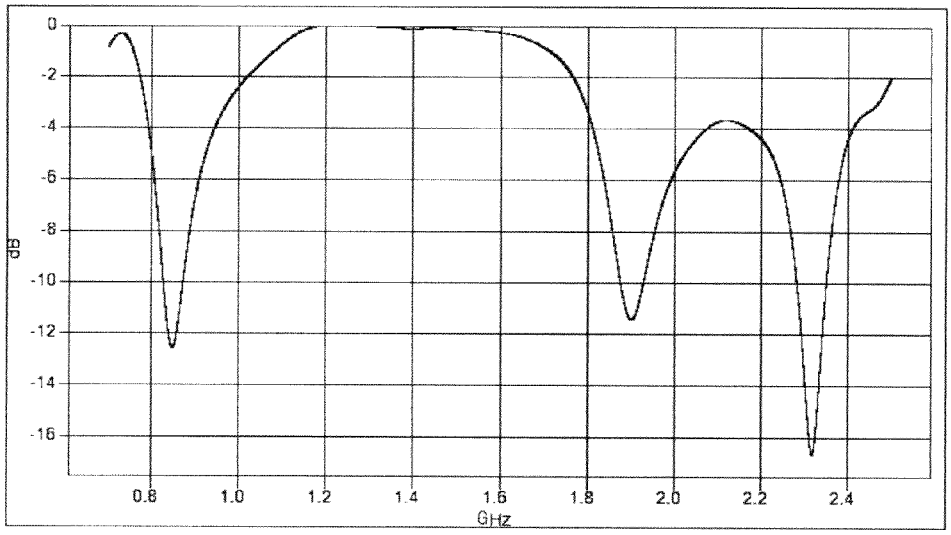
FIG. 4 is reflection loss curve obtained from the dual band antenna assembly according to the present invention.
Figure 5:
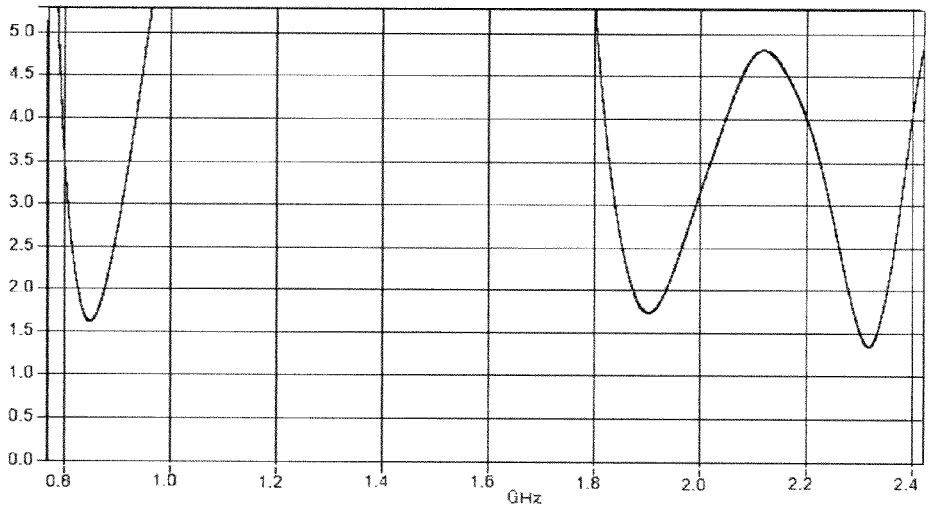
FIG. 5 is a VSWR curve obtained from the dual band antenna assembly according to the present invention.

FIGS. 4 and 5 show the reflection loss curve and VSWR curve obtained from the dual band antenna assembly according to the present invention. When the working frequency of the antenna assembly is under the frequency band of GSM859 or PCS, the standing wave ratio of the dual band antenna assembly is below 3. When the standing wave ratio is below 5, the antenna covers other bands including GSM900, WCDMA.

Figure 6:
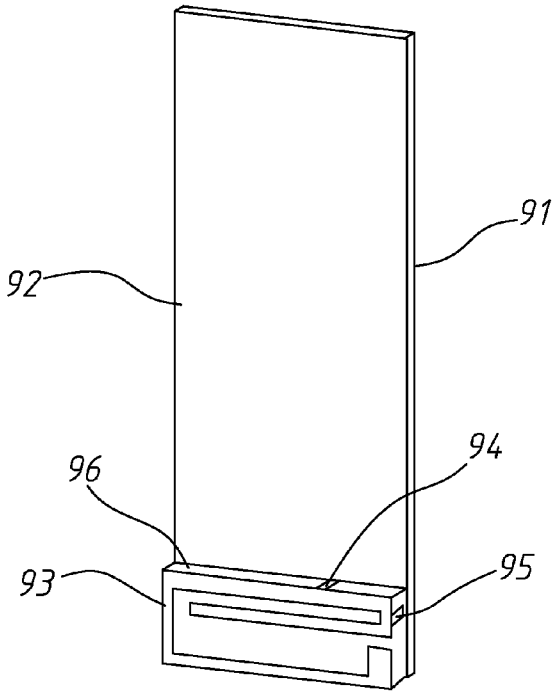
FIG. 6 Prior Art
FIG. 6 is a perspective view of a reference PIFA antenna assembly constructed according to the prior art.

FIG. 6 shows the structure of a conventional PIFA antenna assembly, which comprises a circuit board 91 being a RF4 board, a ground plane 92 carried on the circuit board 91; signal source is fed through a feed line 94 into the antenna where signal source goes through an antenna pad 93 to the grounding lug 95 and then the ground plane 92; reference number 96 indicates an antenna pad holder block.

FIGS. 7 and 8 are HAC performance comparison charts under a low frequency band (824 MHz) and a high frequency band (1980 MHz) between the dual band antenna assembly of the present invention (left) and the reference PIFA antenna assembly (right). When the antenna is disposed under the circuit board and work under 824 MHz, both the antenna of the present invention and the reference PIFA antenna show an efficiency below 88%; the peak electric field and peak magnetic field of HAC of the antenna assembly of the present invention are 254 V/m and 0.375 A/m respectively; the peak electric field and peak magnetic field of HAC of the reference PIFA antenna assembly are 247 V/m and 0.378 A/m respectively. Both show a similar result that meets M3 specification of "ANSI C63,19".

When the antenna is disposed under the circuit board and work under 1980 MHz and both the antenna of the present invention and the reference PIFA antenna show an efficiency below 78%; the peak electric field and peak magnetic field of HAC of the antenna assembly of the present invention are 68.6 V/m and 0.198 A/m respectively; the peak electric field and peak magnetic field of HAC of the reference PIFA antenna assembly are 103 V/m and 0.326 A/m respectively.

Subject to the aforesaid simulation result, both antennas (the invention antenna and the reference antenna) have a similar HAC characteristic at GSM850 (824 NHz~896 MHz) and satisfy M3 specification of "ANSI C63,19".

When at the frequency band of PCS (1850 MHz~1990 MHz) under the same efficiency, the invention shows an improvement above 3.5 dB on electric field and an improvement above 4.3 dB on magnetic field in comparison to the performance of the reference PIFA antenna structure.

Figure 9:
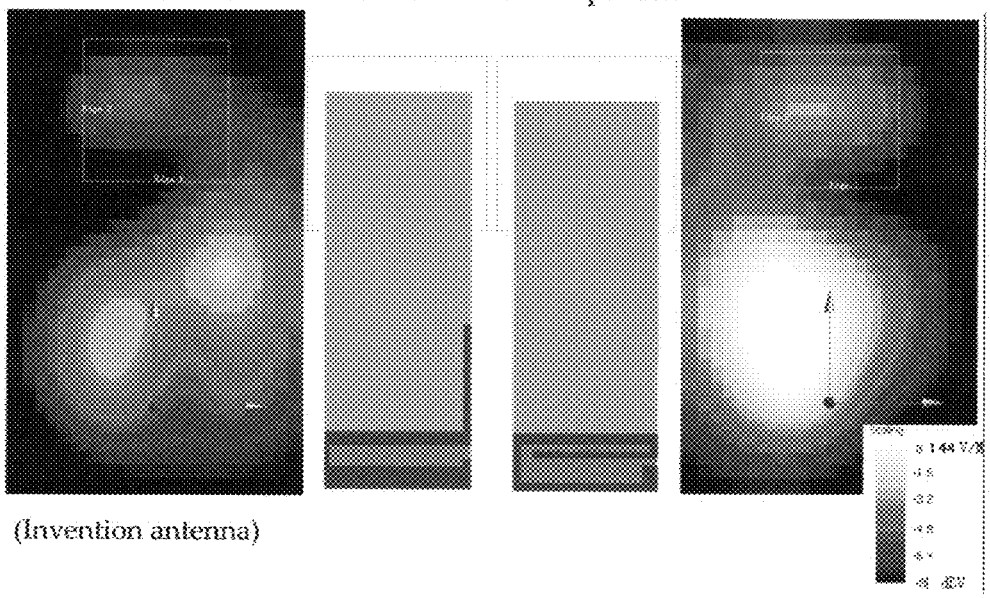
FIG. 9 shows the distributions of electric field under a high frequency band (1980 MHz) of HAC testing on the dual band antenna assembly of the present invention (left) and the reference PIFA antenna assembly (right).
Figure 10:
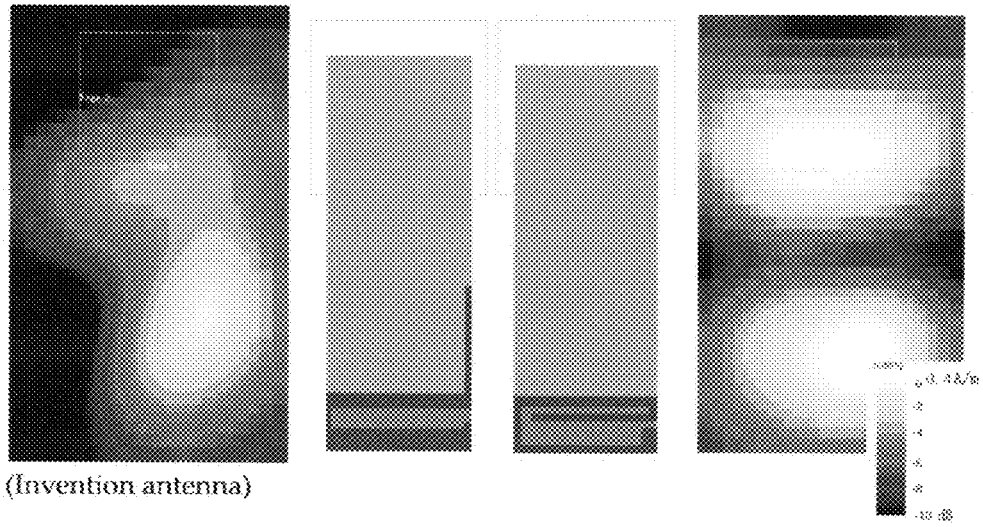
FIG. 10 shows the distributions of magnetic field under a high frequency band (1980 MHz) of HAC testing on the dual band antenna assembly of the present invention (left) and the reference PIFA antenna assembly (right).

FIGS. 9 and 10 show the distributions of electric field and magnetic field under a high frequency band (1980 MHz) of HAC testing on the dual band antenna assembly of the present invention (left) and the reference PIFA antenna assembly (right). As illustrated, when the antenna is disposed under the circuit board and work under 1980 MHz, both the antenna of the present invention and the reference PIFA antenna show an efficiency below 78%; the peak electric field and peak magnetic field of HAC of the antenna assembly of the present invention are 68.6 V/m and 0.198 A/m respectively; the peak electric field and peak magnetic field of HAC of the reference PIFA antenna assembly are 103 V/m and 0.326 A/m respectively. This simulation result shows that both antennas have a similar HAC characteristic at GSM850 (824 MHz~896 MHz) and satisfy y M3 specification of "ANSI C63,19".

When at the frequency band of PCS (1850 MHz~1990 MHz) under the same efficiency, the invention shows an improvement above 3.5 dB on electric field and an improvement above 4.3 dB on magnetic field in comparison to the performance of the reference PFA antenna structure.

Although a particular embodiment of the invention has been described in detail for purposes of illustration, various modifications and enhancements may be made without departing from the spirit and scope of the invention. For example, the first metal radiator and the second metal radiator can be curved, detoured, or made in any of a variety of other configurations. Accordingly, the invention is not to be limited except as by the appended claims.

What the invention claimed is:

1. A built-in straight mobile antenna type dual band antenna assembly, comprising:

a circuit board having a width and a length;

a ground plane arranged on one surface of said circuit board; and an antenna arranged on said circuit board, said antenna comprising a first radiator and a second radiator, said first radiator having a first resonance frequency and being arranged on one end of said circuit board and extending along the width of said circuit board, said first radiator having a first end connected to a feed line for signal input and a second end connected with a grounding lug to said ground plane, said second radiator having a second resonance frequency and being arranged on said circuit board and extending along the length of said circuit board, said second radiator having a first end extended from the first end of said first radiator and a second end connected to said ground plane through said grounding lug, said first radiator and said second radiator constituting a L-shaped structure.

2. The built-in straight mobile antenna type dual band antenna assembly as claimed in claim 1, wherein the resonance frequency of said first radiator is a low frequency, and the resonance frequency of said second radiator is a high frequency.

3. The built-in straight mobile antenna type dual band antenna assembly as claimed in claim 2, wherein said low frequency is GSM850 (824 MHz~896 MHz) frequency band, and said high frequency is PCS (1850 MHz~1990 MHz) frequency band.

4. The built-in straight mobile antenna type dual band antenna assembly as claimed in claim 2, further comprising a first radiator holder block mounted on said circuit board to hold said first radiator, and a second radiator holder block mounted on said circuit board to hold said second radiator.

5. The built-in straight mobile antenna type dual band antenna assembly as claimed in claim 4, wherein said first radiator and said second radiator each comprise an upper pad and a bottom pad arranged at different elevations.

6. The built-in straight mobile antenna type dual band antenna assembly as claimed in claim 5, wherein the upper pad and bottom pad of said first radiator have different shapes.

7. The built-in straight mobile antenna type dual band antenna assembly as claimed in claim 5, wherein said ground plane has the size of 30 mm*110 mm; said first radiator has the size of 40 mm*16 mm; said second radiator has the size of 30 mm*2 mm.

8. The built-in straight mobile antenna type dual band antenna assembly as claimed in claim 5, wherein the total height of said first radiator and said second radiator is below 7 mm; said ground plane has a thickness 1 mm; the gap between the upper pad and bottom pad of said first radiator is 1.5 mm; the gap between the upper pad and bottom pad of said second radiator is 3 mm.

* * * * *